United States Patent [19]

Ishii

[11] Patent Number: 4,720,611

[45] Date of Patent: Jan. 19, 1988

[54] ELECTRO-MANUAL DRAWER LATCH

[75] Inventor: Shiro Ishii, Garden Grove, Calif.

[73] Assignee: M-S Corp., Stanton, Calif.

[21] Appl. No.: 902,952

[22] Filed: Sep. 2, 1986

[51] Int. Cl.[4] ..... H01H 3/16

[52] U.S. Cl. ..... 200/61.61; 235/22

[58] Field of Search ..... 200/61.61, 61.62; 235/10, 11, 22

[56] References Cited

U.S. PATENT DOCUMENTS 3,061,185 10/1962 Richard ..... 200/61.61 X 4,603,239 7/1986 Ishii ..... 200/61.61

FOREIGN PATENT DOCUMENTS 2907643 8/1980 Fed. Rep. of Germany ..... 235/22

OTHER PUBLICATIONS

Berkman, J. W.; IBM Tech. Disc. Bull.; "Multiple Cash Drawer Control"; vol. 10, No. 12, May 1968, pp. 1928, 1929.

Best, J. J. et al.; "IBM Tech. Disc. Bull.", Self-Restoring Latch/Unlatch Mechanism for Logic Controlled Drawer, vol. 17, No. 7, Dec. 1974, pp. 1846, 1847.

*Primary Examiner*—J. R. Scott

*Attorney, Agent, or Firm*—Wenderoth, Lind & Ponack

[57] ABSTRACT

An electro-manual drawer latch for a drawer which in a manual mode locks the drawer when the drawer is pushed into a housing and unlocks the drawer when the drawer is again pushed into the housing and which in an electrical mode prevents the drawer from being manually unlocked by pushing in on the drawer but which unlocks the drawer in response to an electrical signal, the latch including a housing, a drawer slidably mounted in the housing, the drawer having a latch for locking the drawer in housing, a spring disposed between the housing and the drawer for biasing the drawer out of the housing, a locking mechanism disposed in the housing for engaging the latch when the drawer is pushed into the housing to thereby lock the drawer in the housing, the locking mechanism being operable to disengage the latch in either a manual mode in response to a manual push on the drawer or an electrical mode in which manual unlocking of the drawer is prevented and instead the drawer is unlocked in response to an electrical signal received by the locking mechanism, and a control mechanism connected to the locking mechanism for selectively placing the locking mechanism in either the manual mode or the electrical mode, the control mechanism also being operable to supply the electric signal to unlock the drawer when the locking mechanism is in the electrical mode.

20 Claims, 16 Drawing Figures

FIG. 1A
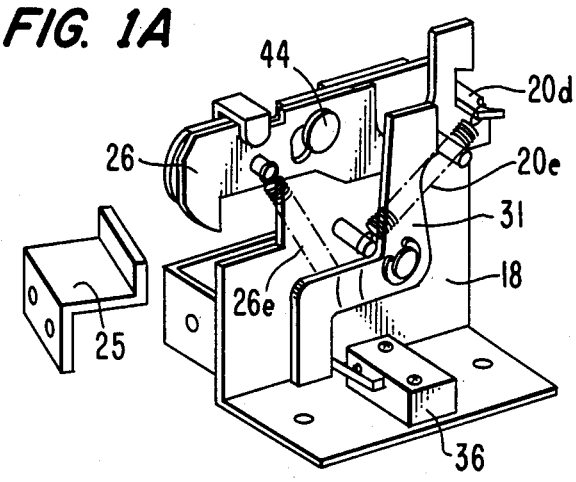
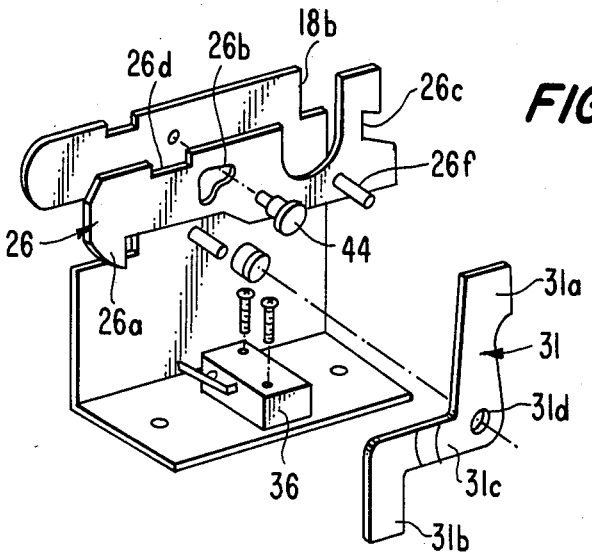
FIG. 1B
FIG. 1C
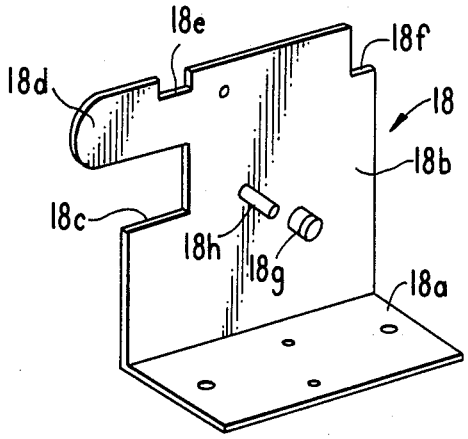

ELECTRO-MANUAL DRAWER LATCH

BACKGROUND OF THE INVENTION

1. Field of the Invention

The present invention relates to a cash drawer which can be operated by both electrical and mechanical means.

2. Description of the Prior Art

There has been disclosed in U.S. Pat. No. 4,159,153 to Fumio Yoshikawa a latch device for the drawer box of a cash register which causes the cash register drawer to be latch-locked when the drawer is pushed into the cash register drawer casing and which causes the cash register drawer to be released from the latch when by a subsequent push on the cash register drawer box. The latch device of Yoshikawa uses a combination of three pivotable levers which cooperate to latch the drawer box when it is pushed into the cash register drawer casing and which cooperate to release the latch-lock by applying a small pushing force on the cash register drawer box.

The three levers of Yoshikawa include a horizontal lever having a hook at a forward end thereof for engaging a stopper on the cash storing drawer, a latch component having a latch hook which engages the horizontal lever to prevent it from pivoting upward to release the stopper on the cash storing drawer and a lock-releasing lever which is effective to release the latch hook of the latch component when the lock-releasing lever is pushed by the stopper of the cash storing drawer so that the stopper will be released from the hook of the horizontal lever due to a spring force which urges the cash storing drawer out of the cash register drawer casing.

There is disclosed in U.S. Pat. No. 3,708,773 to Shiro Ishii, the inventor of the present invention, an electromagnetically actuated latch means for releasing a cash storage drawer from a housing on operation of a switch to control electric power to the electromagnetic means. The electromagnetically actuated latch means of Ishii includes a latch member 4 having a hook portion 4' which is engaged with a C-shaped opening in an arm member having a hook at the opposite end thereof for engaging the stop of a cash drawer, and electromagnetic means which when actuated pivots the latch lock such that an upper hook portion thereof engaging the C-shaped recess in the arm member causes the hook portion of the arm member to be pivoted out of engagement with the stop on the cash-storage drawer. Ishii also provides suitable springs for urging the cash-drawer outwardly from the housing and to return the arm member to a position at which the stop of the cash-storage drawer will be engaged by the hook portion of the arm member when the drawer is again pushed into the housing.

It will be evident from the above discussion that Yoshikawa teaches a manually actuated latch device for drawer and Ishii teaches an electrically actuated latch mechanism for drawers. The present invention is directed at a latch device which can be operated manually or electrically.

SUMMARY OF THE INVENTION

The present invention provides an electro-manual drawer latch for a drawer which in a manual mode locks the drawer when the drawer is pushed into a housing and unlocks the drawer when the drawer is again pushed into the housing and which in an electrical mode prevents the drawer from being manually unlocked but instead unlocks the drawer in response to an electrical signal, the device including a housing, a drawer slidably mounted in the housing, the drawer having latch means thereon for locking the drawer in the housing, spring means disposed between the housing and the drawer for biasing the drawer out of the housing, locking means disposed in the housing for engaging the latch means when the drawer is pushed into the housing, the locking means being operable to disengage the latch means in either a manual mode in response to a manual push on the drawer or an electrical mode in which manual unlocking of the drawer is prevented and instead the drawer is unlocked in response to an electrical signal received by the locking means, and control means connected to the locking means for selectively placing the locking means in either the manual mode or the electrical mode, the control means being operable to supply the electrical signal to unlock the drawer when the locking means is in the electrical mode.

The control means includes a key lock extending through the housing, the key lock including a rotatable lock cam disposed in the housing and switch means connected between the locking means and a power source, the switch means being engagable with the rotatable lock cam to maintain the locking means in the electrical mode when the key lock is in an electrical mode position.

The control means includes a rotatable switch lever which is rotated by the lock cam when the key lock is rotated to the electrical mode position, the switch means including an electrical signal supplying means and a limit switch which is closed to an ON position by the switch lever when the key lock is rotated to the electrical mode position, the control means further including connecting means connected from the switch lever to the locking means for preventing manual unlocking of the drawer when the key lock is in the electrical mode position and for not preventing manual unlocking of the drawer in response to a manual push on the drawer when the key lock is in a manual mode mode position.

The locking means includes an electrically actuated means for unlocking the drawer in response to an electrical signal supplied to the locking means from the control means.

The locking means includes a latch lever means engagable with the latch means for locking the drawer in the housing and a latch lever release means engagable with the latch lever means for preventing the latch lever means from disengaging with the latch means, the electrically actuated means comprising a solenoid having a piston slidable therein, the piston being connected to the latch lever release means to disengage the latch lever release means from the latch lever means to thereby allow the drawer to be unlocked due to pressure exerted thereon by the spring means.

The locking means further includes a manual release arm means for disengaging the latch lever release means from the latch lever means to thereby allow the latch lever means to disengage from the latch means and the drawer to be unlocked due to pressure exerted on the drawer by the spring means, the electrically actuated means being connected to the latch lever release means to disengage the latch lever release means from the latch lever means to thereby allow the latch lever means to disengage from the latch means and the drawer to be unlocked due to pressure exerted on the drawer by the spring means, the connecting means being connected to the manual release arm means to prevent the manual release arm means from disengaging the latch lever release means from the latch lever means when the locking means is in an electrical mode, and the switch means supplying the electrical signal to the electrically actuated means to thereby unlock the drawer when the locking means is in the electrical mode.

The connecting means may comprise a wire connected between the switch lever and the manual release arm means or the connecting means may comprise a pivotable plate means for engaging the manual release arm means and a wire connected between the switch lever and the pivotable plate means whereby the pivotable plate means is pivoted into engagement with the manual release arm means to prevent the manual release arm means from disengaging the latch lever release means from the latch lever means when the key lock is in the electrical mode position.

The control means can further include a further limit switch engagable directly with the latch lever means or engagable with a switch contact lever which is actuated by the latch lever means, the further limit switch being operable to interrupt the supply of power to the solenoid when the latch lever means is pivoted out of engagement with the latch means on the drawer.

BRIEF DESCRIPTION OF THE DRAWINGS

The foregoing and other objects, features and advantages of the invention as well as presently preferred embodiments thereof, will become more apparent from a reading of the following description in connection with the accompanying drawings in which:

FIG. 1A shows a perspective view of the electromechanical drawer latch of the present invention;

FIG. 1B shows a perspective view of some of the parts of FIG. 1A before they are mounted on a base bracket;

FIG. 1C shows the base bracket shown in FIGS. 1A and 1B;

DETAILED DESCRIPTION OF THE PREFERRED EMBODIMENTS

Figure 3:
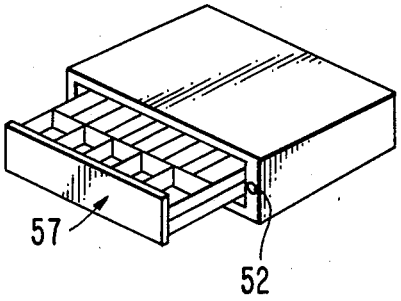
FIG. 3 is a perspective view of a drawer in a housing having the electro-mechanical drawer latch of the present invention therein.
Figure 4:
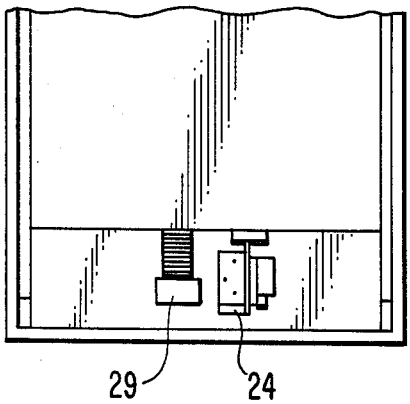
FIG. 4 is a cut-away view showing the electromechanical drawer latch of the present invention installed in the interior of a housing and engaged with a drawer.

The electro-mechanical latch mechanism of the present invention is shown generally in FIG. 1A and will be described as follows. A cash drawer 30 is slidably mounted in a housing H as shown in FIG. 3, and a locking means 24 locks a detent 27 of a drawer latch 25 mounted on the rear of the drawer 30 in the housing H against the force of a spring 29, which urges the drawer 30 out of the housing H when the latch mechanism 24 unlocks the drawer 30, as shown in FIG. 4.

The locking means 24 comprises a latch mechanism which includes an L-shaped base bracket 18 which has a horizontal bottom portion **18*a* fixedly secured to the housing and a rectangular vertical portion 18*b* which extends at a right angle therefrom. The rectangular portion 18*b* has a rectangular cut-out 18*c* extending inwardly from a forward edge thereof, an extension 18*d* defined by the top edge of the cut-out and the top edge of the rectangular portion 18*b*, the extension having a rounded forward edge and a rectangular cut-out 18*e* formed along the top edge of the rectangular portion 18*b* at a position rearward of the rounded forward edge of the extension 18*d* and a cut-out 18*f* is formed at the rear upper corner of the rectangular portion 18*b***.

The locking means also includes a latch lever means comprising a latch lever 26 which is pivotally attached to one side of the rectangular portion **18*b*, as shown in FIG. 1B. The latch lever 26 includes a rounded forward edge which has a hook shaped portion 26*a* at a lower end thereof. The latch lever 26 has a slot 26*b* which has a forward vertically extending portion and a rearward horizontal portion extending rearwardly from the upper part of the vertically extending portion. A pivot pin 44 extends from the vertical portion 18*b* of the base bracket 18 and through the slot 26*b* to pivotally attach the latch lever 26 to the base bracket 18 such that the upper edge of the latch lever 26 is generally aligned with the top edge of the base bracket 18 when the latch lever 26 is in a horizontal position. The slot 26*b* thus allows the latch lever 26 to move a slight distance in either the horizontal direction or in the vertical direction with respect to the base bracket 18. The rear end of the latch lever 26 has a cut-out 26*c* formed therein and the top edge of the front end of the latch lever 26 has a cut-out 26*d* formed therein. A spring 26*e* is provided between the forward end of the latch lever 26 and a central lower portion of the vertical portion 18*b* of the base bracket 18 for maintaining the forward end of the latch lever 26 in a horizontal position. The latch lever 26** also includes a pin 26*f* extending from the rear end thereof in a direction away from the vertical portion 18*b* of the base bracket. The function of the cut-out 26*c*, the cut-out 26*d* and the pin 26*f* will be explained in detail later.

Figure 5:
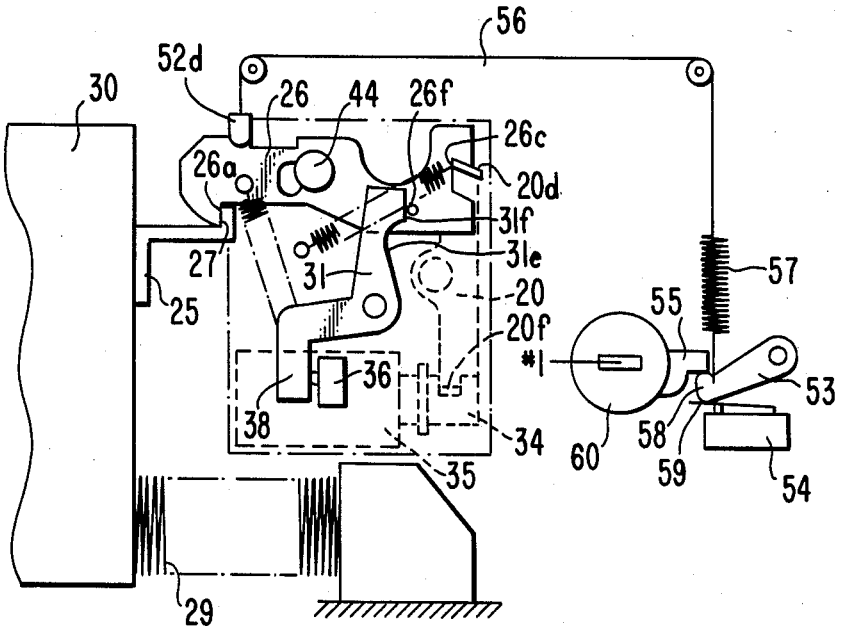
FIG. 5 is a side elevation view of the electro-manual drawer latch of the present invention when in an electrical mode with a latch lever engaged with a drawer latch.
Figure 6:
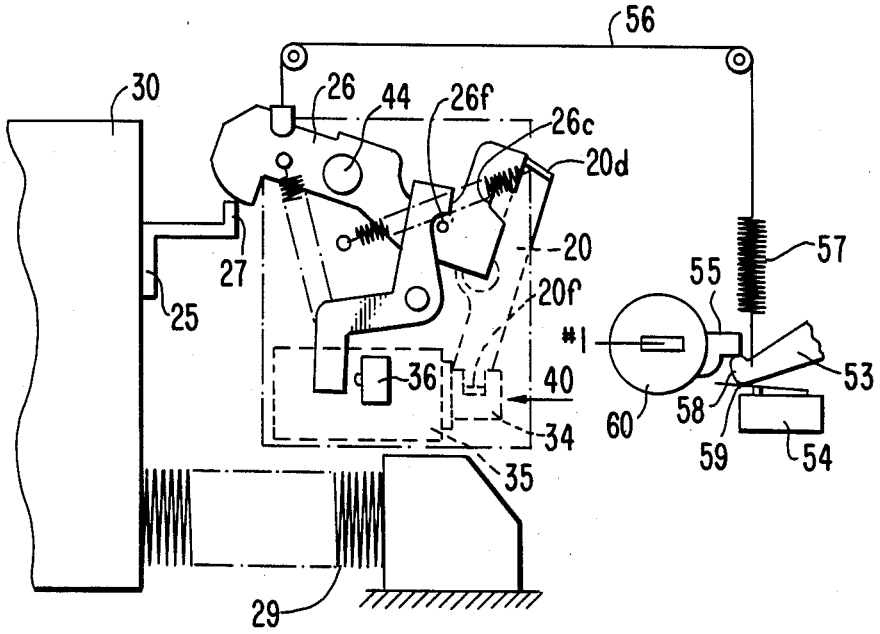
FIG. 6 is a side elevation view of the electromechanical drawer latch shown in FIG. 5 when the latch lever is pivoted out of engagement with the drawer latch.

According to a first embodiment of the locking means, an S-shaped switch contact lever 31 is pivotally mounted on the same side of the vertical portion 18*b* of the base bracket 18 as the latch lever 26. The switch contact lever 31 has a vertical upper rearward section 31*a*, a vertical lower forward section 31*b* and a horizontal central section 31*c* connecting the forward section 31*b* to the rearward section 31*a*. An opening 31*d* is provided in the central section 31*c* for receiving a pin 18*g* extending from the vertical portion 18*b* of the base bracket 18 to thereby pivotally attach the switch contact lever 31 to the base bracket 18. The rearward section 31*a* has a recess 31*e*, as shown in FIG. 5, along a rear edge 31*f* thereof for receiving the pin 26*f* of the latch lever 26 when the latch lever 26 is pivoted in a clockwise direction, as shown in FIG. 6. Thus, it will be seen from FIG. 1A that the switch contact lever 31 is held in position by the pin 26*f* which bears against the rear edge 31*f* of the rearward section 31*a* of the switch contact lever 31.

Also, according to the first embodiment of the locking means, there is provided a limit switch 36 mounted on the bottom portion 18*a* of the base bracket 18 such that a spring contact of the limit switch 36 is normally closed allowing current to pass through the limit switch 36 when it is in contact with the rear edge of the forward section 31*b* of the switch contact lever 31. However, when the latch lever 26 is pivoted in the clockwise direction with the pin 26*f* engaging the recess 31*e*, the limit switch 36 is in an open or OFF position.

Figure 2A:
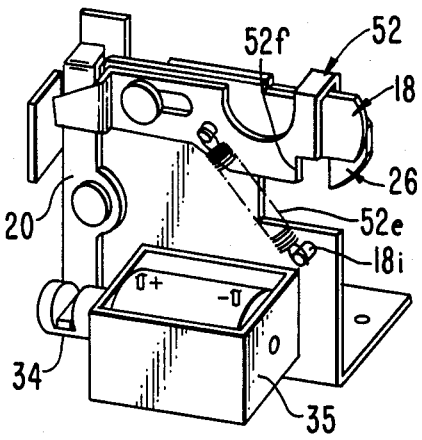
FIG. 2A shows a perspective view of the electromechanical drawer latch shown in FIG. 1A from the opposite side of the base bracket.
Figure 2B:
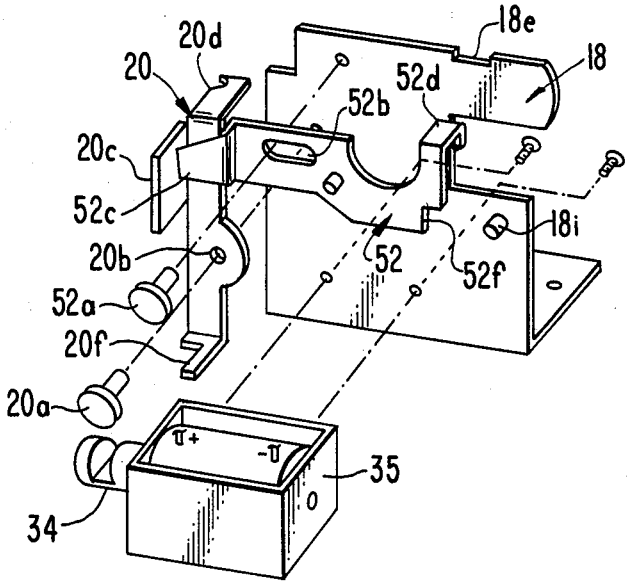
FIG. 2B is a perspective view of some of the parts shown in FIG. 2A before they are mounted on the base bracket.
Figure 2C:
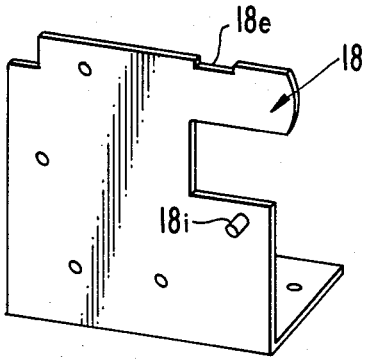
FIG. 2C is a perspective view of the base bracket shown in FIGS. 2A and 2B.

FIGS. 2A–2C show the parts of the locking means mounted on the opposite side of the base bracket 18. As shown in FIG. 2B, a manual release arm means comprising a manual release arm 52 is pivotally mounted adjacent the top edge of the vertical portion 18*b* of the base bracket 18 by means of a pivot pin 52*a* which is received in a horizontally extending elongated slot 52*b* at a rear end of the manual release arm 52 which thus allows the manual release arm 52 to pivot in a vertical plane and move in a forward and rearward direction with respect to the base bracket 18. The rear end of the manual release arm 52 has an L-shaped extension 52*c* formed by a first bent portion in the manual release arm 52 which extends away from the vertical portion 18*b* and a second bent portion extending parallel to the vertical portion 18*b* of the base bracket 18. The purpose of the extension 52*c* will be explained later. A locking portion 52*d* is formed at the forward end of the manual latch release arm 52. The locking portion 52*d* is formed by a horizontal bent portion extending perpendicularly from a top edge of the manual release arm 52 such that it overlies the top edge of the vertical portion 18*b* of the base bracket 18 and the top edge of the latch lever 26. The locking portion 52*d* also includes a vertical bent portion which is parallel to the vertical portion 18*b* of the base bracket 18 extending from the horizontal bent portion towards the bottom portion 18*a* of the base bracket 18. A spring 52*e*, shown in FIG. 2A, extends between a central portion of the manual release arm 52 to a pin 18*i* extending from a forward portion of the opposite side of the vertical portion 18*b* at a position below the cut-out 18*c* to thereby bias the manual release arm 52 in a forward position with the pivot pin 52*a* received in a rearmost portion of the elongated slot 52*b*.

Also, pivotally mounted on the opposite side of the vertical portion 18*b* of the base bracket 18 is a latch lever release arm means comprising a latch lever release arm 20. A pivot pin 20*a* extends through an opening 20*b* in the latch lever release arm 20 and the pivot pin 20*a* is joined to the vertical portion 18*b* such that the latch lever release arm 20 is pivotal in a vertical plane which is parallel to the vertical portion 18*b*. A bent portion 20*c* extends perpendicularly from an upper rear edge of the latch lever release arm 20 in a direction away from the vertical portion 18*b* such that the bent portion 20*c* engages the rear end of the L-shaped extension 52*c* of the manual release arm 52 whereby rearward movement of the manual release arm 52 pivots the latch lever release arm 20 in a counterclockwise direction in FIG. 2B. An extension 20*d* extends perpendicularly from the top edge of the latch lever release arm 20 in a direction towards the vertical portion 18*b* of the base bracket 18 such that the extension 20*d* is received in the cut-out 18*f* of the base bracket 18 and bears against the cut-out 26*c* in the latch lever 26, as shown in FIG. 1A. A spring 20*e* extends from the extension 20*d* to a pin 18*h* mounted centrally on the side of the vertical portion 18*b* on which the latch lever 26 and switch contact lever 31 are mounted. The lower end of the latch lever release arm 20 has an actuating arm 20*f* extending perpendicularly therefrom in a direction away from the vertical portion 18*b*.

The locking means further includes an electrically actuated means such as a solenoid 35 having a piston 34 with a slot therein for receiving the actuating arm 20*f* of the latch lever release arm 20. The solenoid is also mounted on the same side of the vertical portion 18*b* of the base bracket 18 as the manual latch release arm 52 and the latch lever release arm 20. The piston 34 is caused to move forward into the solenoid 35 when the solenoid 35 is connected to a source of electrical energy, thus the latch lever release arm 20 is rotated in a counterclockwise direction, as shown in FIG. 2A and FIG. 8, to release engagement of the extension 20*d* on the latch lever release arm 20 with the cut-out 26*c* of the latch lever 26 to thereby allow the latch lever to pivot in a counterclockwise direction, as shown in FIG. 6, in a manner to be described later.

Figure 8:
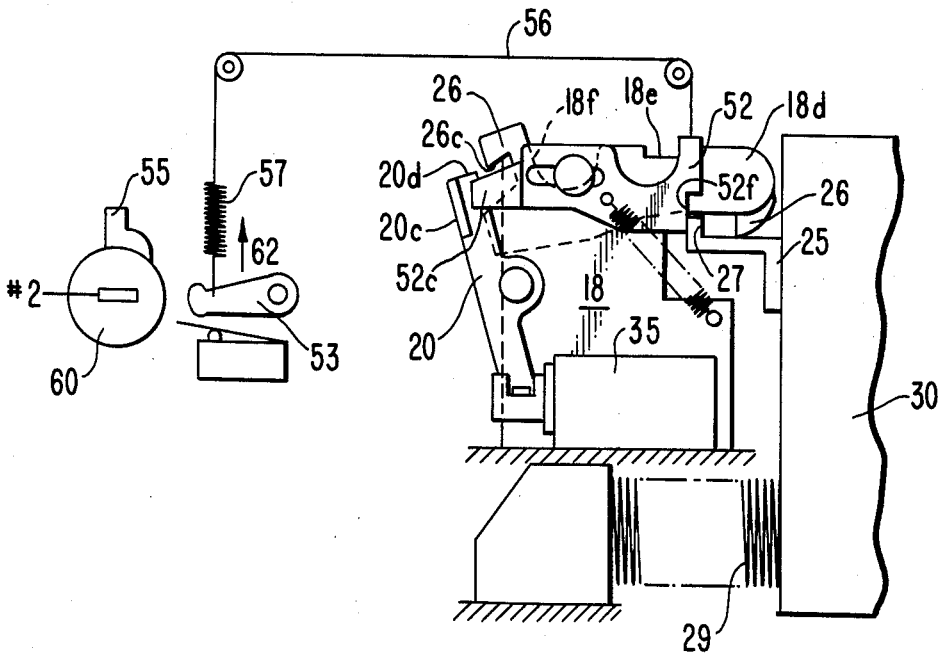
FIG. 8 is a side elevation view of the electromechanical drawer latch of the present invention when in a mechanical mode with the manual release arm positioned to engage the drawer latch when the drawer is pushed towards the manual release arm.

In the manual mode, the hook portion 26*a* of the latch lever 26 can be released from engagement with the drawer latch 25 by rearward movement of the manual release arm 52 due to contact of the drawer latch 25 with a cut-out portion 52*f* on the manual release arm 52, as shown in FIG. 8, since when the manual release arm 52 is moved rearwardly, the locking portion 52*d* engages the cut-out 18*e* in the base bracket 18 which prevents the manual release arm 52 from moving forward, thus holding the extension 20*d* of the latch lever release arm 20 out of engagement with the cut-out 26*c* in the latch lever 26 to thereby allow the hook portion 26*a* of the latch lever 26 to pivot out of engagement with the drawer latch 25 when the drawer 30 is urged forwardly by the spring 29 as shown in FIG. 6.

In the electrical mode, the solenoid 35 is actuated to retract the piston 34 in the direction of arrow 40 (shown in FIG. 6) and thus pivot the latch lever release arm 20 such that the extension 20*d* is brought out of engagement with the cut-out 26*c* in the latch lever 26 which thereby allows the spring force of the spring 29 to push the drawer forwardly and pivot the hook portion 26*a* of the latch lever out of engagement with the drawer latch 25 since the latch lever 26 is free to pivot in a clockwise direction around the pivot pin 44, as shown in FIG. 6, when the latch lever release arm 20 is not engaged with the latch lever 26 as explained above.

Figure 7:
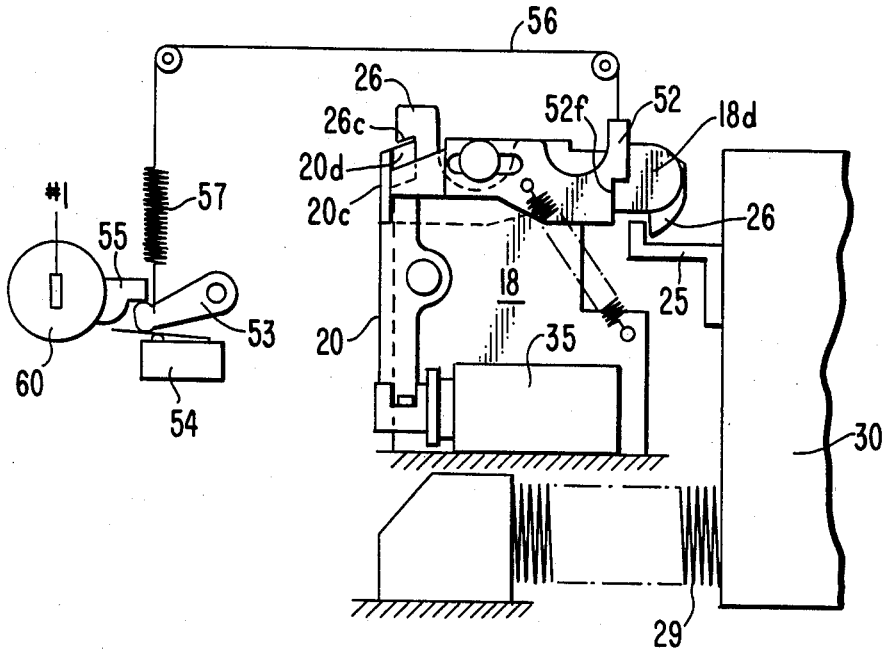
FIG. 7 is a side elevation view of the electro-manual drawer latch of the present invention when in an electrical mode with a manual release arm pivoted such that it will not engage the drawer latch when the drawer is pushed towards the manual release arm.

FIGS. 5–8 show the control means of the invention used for placing the locking means 24 in a mechanical mode or an electrical mode. The control means includes switch means comprising a key lock 60 mounted at a suitable location on the housing H, such as at the position shown in FIG. 3. The key lock 60 has a lock cam 55 disposed in the interior of the housing H, the lock cam 55 being rotatable to an electric mode position #1 as shown in FIG. 7 and a manual mode position #2 as shown in FIG. 8. The switch means further includes a switch lever 53 pivotally mounted in the interior of the housing H such that an end thereof is engaged with an end 58 of the lock cam 55 when the lock cam is rotated to the position shown in FIG. 7. The control means also includes connecting means, such as a wire 56 which has a spring 57 interposed along its length and which is connected at one end thereof to the end of the switch lever 53 which is engaged by the lock cam 55 and at the other end thereof to the locking release portion **52*d* of the manual release arm 52, as shown in FIGS. 7 and 8. A series of pulleys 56*a*, 56*b* support the wire 56 and the spring 57 disposed between opposite ends of the wire 56 biases the switch lever 53 in the direction of arrow 62 (as shown in FIG. 8) when the lock cam 55 is in the manual mode #2. Movement of the switch lever 53 by the lock cam 55 in a direction opposite to the direction of arrow 62 causes the wire 56 to lift the manual release arm 52 such that the drawer latch 25 will not engage the cut-out portion 52*f* of the manual release arm 52 when the drawer 30 is pushed into the housing, whereby the drawer 30 is prevented from being manually unlocked since the extension 20*d* remains in engagement with the cut-out 26*c* of the latch lever 26 thus preventing the latch lever 26 from pivoting out of engagement with the drawer latch 25**.

The control means also includes switch means comprising an electrical signal sending means and a limit switch 54 which is disposed in the interior of the housing H such that a normally open spring contact 59 is engaged with the cam lock 55 when the cam lock is rotated to the electrical mode position shown in FIGS. 5–7. The limit switch 54 can be connected in series to a power source P, the signal sending means such as a push button switch represented at 65 in FIG. **11*a*, the limit switch 36 and the solenoid 35 such that when the push button switch 65 is pressed power is supplied to the solenoid 35, which in turn pivots the latch lever release arm 20 out of engagement with the latch lever 26 and the drawer 30 is unlocked. When the latch lever 26 is pivoted out of engagement with the drawer latch 27, the limit switch 36 is placed in an OFF position and power is interrupted to the solenoid 35. The latch lever 26 is then pivoted back to its normal position by means of the spring 26*e* and the extension 20*d* of the latch lever release arm 20 again engages the cut-out 26*c* on the latch lever 26**.

Figure 11A:
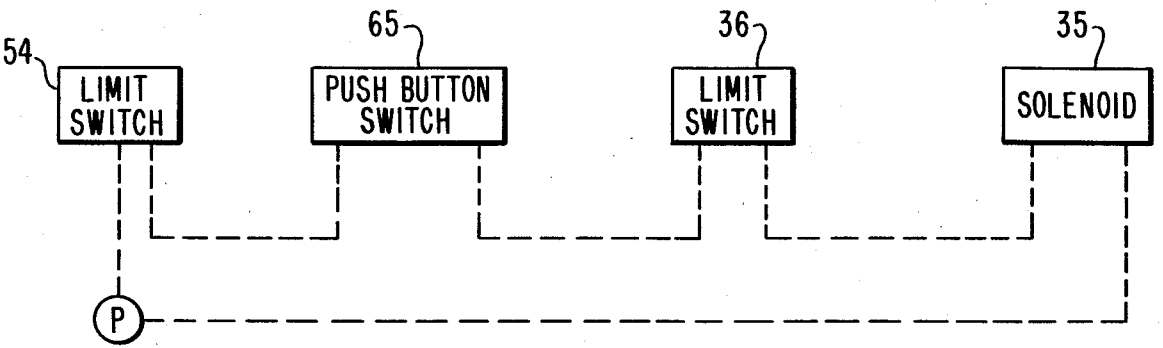
FIG. 11A is a circuit diagram of one embodiment of the present invention.
Figure 11B:
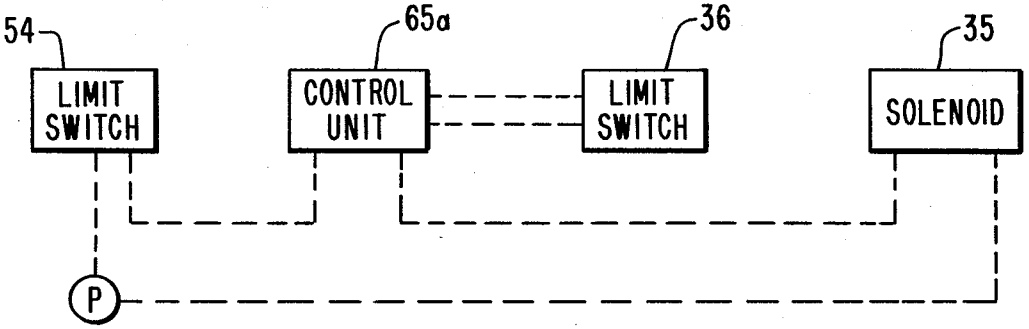
FIG. 11B is another embodiment of the circuit diagram of the present invention.

Alternatively, the electrical signal means can comprise a control unit **65*a* which monitors the condition of the limit switch 36, as shown in FIG. 11*b*. In this case the control unit 65*a* is connected in series to the limit switch 54, the solenoid 35 and a power source P with the limit switch 36 being connected only to the control unit 65*a***. Other suitable variations of the control circuit for the electro-mechanical drawer latch of the present invention are also possible.

Figure 9:
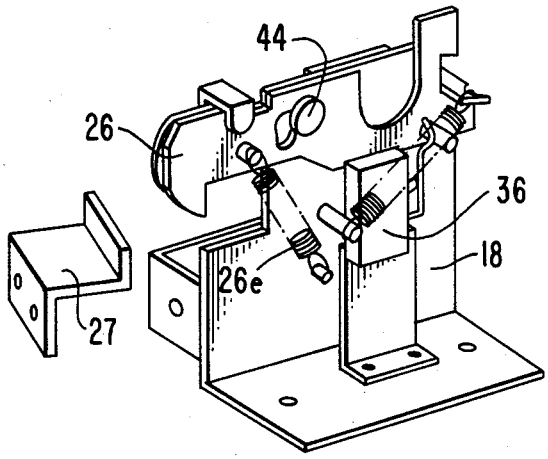
FIG. 9 is a perspective view of another embodiment of the present invention wherein a limit switch is mounted on the base bracket for direct engagement with a pin on the latch lever.

In another embodiment of the locking means, as shown in FIG. 99A, the switch contact lever 31 is omitted and instead a limit switch **36*a* is mounted on the bottom portion 18*a* of the base bracket 18 such that the spring contact is in a normally open or ON position but is moved to a closed or OFF position by the pin 26*f* on the latch lever 26. However, when the drawer is unlocked and thus engaged with the hook portion 26*a* of the latch lever 26, the pin 26*f* is pivoted into engagement with the spring contact of the limit switch 36 which is then placed in an open or OFF position. The other parts of the invention and operation thereof, shown in FIG. 9**, remain the same as in the first embodiment of the invention and the corresponding parts are indicated by like reference numerals.

Figure 10:
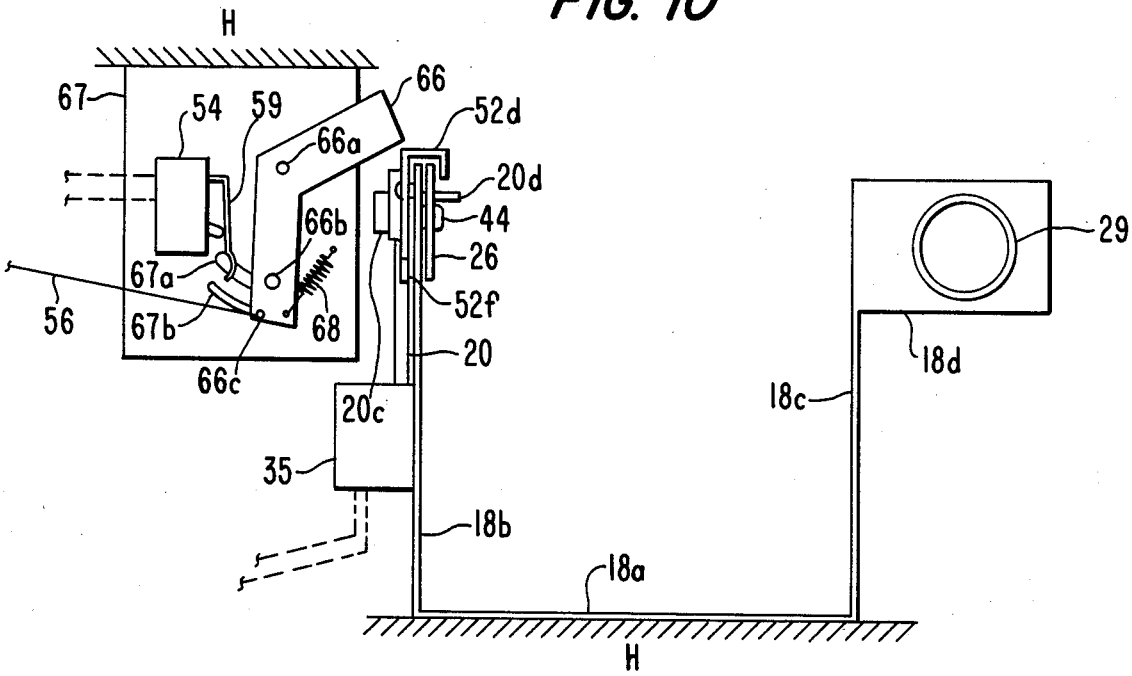
FIG. 10 is a front view of another embodiment of the present invention wherein a pivotable plate is engagable with the manual release arm to pivot the manual release arm such that it will not engage the drawer latch.

Another embodiment of the connecting means of the control means of the present invention is shown in FIG. 10, wherein the wire 56 is not directly attached to the manual release arm 52 as shown in FIGS. 7 and 8, but instead is attached to the lower end of an inverted V-shaped actuator plate 66. The plate 66 is pivoted by means of a pivot pin **66*a* fixed to a support plate 67 mounted on the housing H whereby the actuator plate 67 can be pivoted to engage the upper edge of the rearwardly extending extension 52*c* of the manual release arm 52 to thereby pivot the manual release arm 52 such that the cut-off portion 52*f* on the front end thereof will not engage the drawer latch 25 when the drawer 30 is pushed rearwardly into the housing H. In FIG. 10, the limit switch 54 is mounted on the support plate 67 such that a pin 66*b* which travels in an arcuate slot 67*a* of the support plate 67 engages the spring contact 59 when the actuator plate 66 is rotated to engage with the extension 52*c* of the manual release arm 52. A second pin 66*c* can be provided on the actuator plate 66 to attach the wire 56 to the actuator plate 66 and to guide the actuator plate along an arcuate slot 67*b* formed in the support plate 67. In this embodiment, the base bracket 18 includes a portion 18*c* extending upwardly from the bottom portion 18*a* with a portion 18*d* supporting the spring 29 extending perpendicularly from the portion 18*c*. Also, a spring 68 can be provided between the lower end of the actuator plate 66 and the support plate 67 to bias the actuator plate 66 away from the manual release arm 52**.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An electro-manual drawer latch for a drawer which in a manual mode locks the drawer when the drawer is pushed into a housing from an unlocked position and unlocks the drawer when the drawer is pushed further into the housing from a locked position and which in an electrical mode prevents the drawer from being manually unlocked by pushing the drawer further into the housing from a locked position and instead unlocks the drawer in response to an electrical signal, comprising:

a housing;

a drawer slidably mounted in said housing, said drawer having latch means thereon for locking said drawer in said housing;

spring means disposed between said housing and said drawer for biasing said drawer out of said housing;

locking means disposed in said housing for engaging and disengaging said latch means in a manual mode and in an electrical mode, said locking means engaging with said latch means when said drawer is manually pushed from an unlocked position into said housing to a locked position to thereby lock said drawer in said housing and disengaging with said latch means when said drawer is pushed from said locked position further into said housing when said locking means is in said manual mode and said locking means being prevented from disengaging with said latch means in response to a manual push on said drawer which moves said drawer from said locked position to a position further in said housing when said locking means is in said electrical mode, said locking means disengaging with said latch means in said electrical mode in response to an electrical signal received by said locking means; and control means connected to said locking means for selectively placing said locking means in either said manual mode or said electrical mode, said control means further supplying said electrical signal to unlock said drawer when said locking means is in said electrical mode.

2. The electro-manual drawer latch of claim 1, wherein said control means includes a key lock extending through said housing, said key lock including a rotatable lock cam disposed in said housing, said control means further including a power source and switch means connected electrically between said locking means and said power source, said switch means being engagable with said rotatable lock cam for maintaining said locking means in said electrical mode when said key lock is in an electrical mode position and said switch means including signal sending means for sending said electrical signal to said locking means to unlock said drawer.

3. The electro-manual drawer latch of claim 2, wherein said control means includes a rotatable switch lever which is rotated by said lock cam when said key lock is rotated to said electrical mode position, said switch means further including a limit switch connected between said power source and said locking means which allows current to pass therethrough when said key lock is rotated to said electrical mode position, said control means further including connecting means connected between said switch lever and said locking means for preventing manual unlocking of said drawer by pushing said drawer from said locked position to a position further into said housing when said key lock is in said electrical mode position and for allowing manual unlocking of said drawer in response to a manual push on said drawer from said locked position to a position further into said housing when said key lock is not in said electrical mode position.

4. The electro-manual drawer latch of claim 1, wherein said locking means includes an electrically actuated means for unlocking said drawer in response to said electrical signal supplied to said locking means from said control means.

5. The electro-manual drawer latch of claim 4, wherein said locking means includes a latch lever means for engaging said latch means to maintain said drawer in said locked position in said housing and for disengaging said latch means to allow said drawer to be pushed to said unlocked position by said spring means, said locking means further including a latch lever release arm means for engaging said latch lever means to prevent said latch lever means from disengaging with said latch means, said electrically actuated means comprising a solenoid having a piston slidable therein, said piston being connected to said latch lever release arm means and movable from a first position at which said latch lever release arm means engages said latch lever means to a second position at which said latch lever release arm means disengages said latch lever means to thereby allow said drawer to be unlocked due to pressure exerted thereon by said spring means when said piston is in said second position.

6. The electro-manual drawer latch of claim 1, wherein said locking means includes a latch lever means for engaging said latch means to maintain said drawer in said locked position in said housing and for disengaging said latch means to allow said drawer to be pushed to said unlocked position by said spring means, said locking means further including a latch lever release arm means for engaging said latch lever means to prevent said latch lever means from disengaging with said latch means, a manual release arm means for disengaging said latch lever release arm means from said latch lever means whereby said latch lever means disengages said latch means and said drawer moves to said unlocked position due to pressure exerted on said drawer by said spring means, and electrically actuated means connected to said latch lever release arm means for disengaging said latch lever release arm means from said latch lever means to thereby allow said drawer to be unlocked due to pressure exerted on said drawer by said spring means, said control means including connecting means connected to said manual release arm means for preventing said manual release arm means from disengaging said latch lever release arm means from latch lever means due to pushing said drawer from said locked position further into said housing when said locking means is in said electrical mode, and said control means including switch means for supplying said electrical signal to said electrically actuated means to thereby disengage said latch lever release arm means from said latch lever means to unlock said drawer when said locking means is in said electrical mode.

7. The electro-manual drawer latch of claim 6, wherein said control means includes a key lock extending through said housing, said key lock including a rotatable lock cam disposed in said housing, said control means further including a power source, said switch means being connected between said locking means and said power source, said switch means being engagable with said rotatable lock cam to maintain said locking means in said electrical mode when said key lock is in an electrical mode position.

8. The electro-manual drawer latch of claim 7, wherein said control means includes a rotatable switch lever which is rotated to a first position by said lock cam when said key lock is rotated to said electrical mode position, said switch means including a limit switch engagable with said switch lever when said switch lever is in said first position, said limit switch being electrically connected between said locking means and said power source and allowing current to pass therethrough when said switch lever is in said first position due to rotation of said key lock to said electrical mode position.

9. The electro-manual drawer latch of claim 8, wherein said connecting means comprises a wire connected between said switch lever and said manual release arm means.

10. The electro-manual drawer latch of claim 8, wherein said connecting means comprises pivotable plate means for engaging said manual release arm means and a wire connected between said switch lever and said pivotable plate means whereby said pivotable plate means is pivoted into engagement with said manual release arm means to prevent said manual release arm means from disengaging said latch lever release arm means from said latch lever means when said switch lever is in said first position due to rotation of said key lock to said electrical mode position.

11. An electro-manual drawer latch which comprises:

a housing;

a drawer slidably mounted for movement in a longitudinal direction rearward into said housing and forward out of said housing, said drawer having a drawer latch mounted thereon;

spring means disposed between said housing and said drawer for biasing said drawer in said forward direction out of said housing;

a base bracket disposed in said housing, said base bracket having an edge extending in said longitudinal direction and a cut-out formed along said edge;

a latch lever extending in said longitudinal direction and which is slidably and pivotally mounted to said base bracket, said latch lever having a hook portion at one end thereof which is engagable with said drawer latch to maintain said drawer in a locked position, means connected between said latch lever and said base bracket for biasing said latch lever into engagement with said drawer latch, said latch lever having a cut-out at an opposite free end thereof;

a latch lever release arm pivotally mounted to said base bracket and having an extension engagable with said cut-out in said opposite free end of said latch lever to prevent said latch lever from pivotal movement when said extension is engaged with said cut-out, said latch lever release arm also having a portion extending therefrom for pivoting said latch lever release arm away from said latch lever to thereby disengage said extension from said cut-out in said latch lever so that said latch lever is free to pivot and disengage said hook portion thereof from said drawer latch and said drawer is opened due to said spring means biasing said drawer outwardly from said housing, and means connected between said latch lever release arm and said base bracket for biasing said extension into engagement with said cut-out in said latch lever;

a manual release arm slidably and pivotally mounted on said base bracket, said manual release arm having a portion at one end thereof for abutting said drawer latch when said drawer is pushed rearwardly from said locked position further into said housing and means at the other end thereof for engaging said portion of said latch lever release arm when said manual release arm is pushed rearwardly into said housing by said drawer latch due to movement of said drawer from said locked position further into said housing to thereby release engagement of said extension of said latch lever release arm with said cut-out in said latch lever when said latch lever is pulled in said forward direction by said drawer latch due to the bias exerted by said spring means on said drawer, said manual release arm also including a locking portion for engaging said latch lever when said latch lever is pivoted out of engagement with said drawer latch and engaging said cut-out on said base bracket when said manual release arm is pushed rearwardly by said drawer latch due to movement of said drawer from said locked position further into said housing to thereby hole said latch lever release arm out of engagement with said latch lever as said latch lever is pulled in said forward direction by said drawer latch due to the bias exerted by said spring means on said drawer so that said hook portion of said latch lever is pivoted out of engagement with said drawer latch and means connected between said manual release arm and said base bracket for biasing said manual release arm in said forward direction with said locking portion of said manual release arm biased against said edge of said base bracket whereby said locking portion of said manual release arm is moved in said forward direction into engagement with said cut-out in said base bracket initially as said drawer is pushed further into said housing from said locked position and then out of engagement with said cut-out in said base bracket when said latch lever is pivoted out of engagement with said drawer latch; and control means disposed in said housing for selectively pivoting said manual release arm from a first position at which said drawer latch is not engagable with said portion at said one end of said manual release arm when said drawer is pushed from said locked position in said rearward direction to a second position at which said drawer latch is engagable with said portion of said one end of said manual release arm when said drawer is pushed from said locked position in said rearward direction, said first position corresponding to an electrical mode of said control means and said second position corresponding to a manual mode of said control means, said control means including electrically actuated means disposed in said housing for unlocking said drawer when said control means in said electrical mode by pivoting said extension of said latch lever release arm out of engagement with said cut-out in said latch lever in response to an electrical signal supplied to said electrically actuated means whereby said latch lever is pivoted out of engagement with said drawer latch and said drawer is moved in said forward direction due to said spring means, and said control means including switch means for selectively supplying said electrical signal to said electrically actuated means and connecting means for selectively pivoting said manual release arm from said second position when said switch means is in a manual mode corresponding to said manual mode of said control means to said first position when said switch means is in an electrical mode corresponding to said electrical mode of said control means, said switch means disconnecting said electrically actuated means from a power source when said switch means is in said manual mode.

12. The electro-manual drawer latch of claim 11, wherein said control means includes a key lock extending through said housing, said key lock including a rotatable lock cam disposed in said housing, said switch means being engagable with said rotatable lock cam to maintain said locking means in said electrical mode when said key lock is in an electrical mode position.

13. The electro-manual drawer latch of claim 12, wherein said control means includes a rotatable switch lever which is rotated to a first position by said lock cam when said key lock is rotated to said electrical mode position, said switch means including an electrical signal sending means and a limit switch engagable with said switch lever when said switch lever is in said first position, said limit switch allowing current to pass therethrough when said switch lever is in said first position due to rotation of said key lock to said electrical mode position, said connecting means connected from said switch lever to said manual release arm for moving said manual release arm from said first position to said second position thereby preventing manual unlocking of said drawer when said drawer is in said locked position and said key lock is in said electrical mode position and allowing manual unlocking of said drawer in response to a manual push on said drawer when said drawer is in said locked position and said key lock is in a manual mode position.

14. The electro-manual drawer latch of claim 13, wherein said connecting means comprises a wire connected between said switch lever and said manual release arm.

15. The electro-manual drawer latch of claim 13, wherein said connecting means comprises pivotable plate means for engaging said manual release arm and a wire connected between said switch lever and said pivotable plate means whereby said pivotable plate means is pivoted into engagement with said manual release arm to prevent said manual release arm from disengaging said latch lever release arm from said latch lever when said key lock is in said electrical mode position.

16. An electro-manual drawer latch for a drawer which in a manual mode locks the drawer when the drawer is pushed into a housing from an unlocked position and unlocks the drawer when the drawer is pushed further into the housing from a locked position and which in an electrical mode prevents the drawer from being manually unlocked by pushing the drawer from the locked position further into the housing but instead unlocks the drawer in response to an electrical signal, comprising:

a housing;

a drawer slidably mounted in said housing, said drawer having latch means thereon for locking said drawer in said housing;

spring means disposed between said housing and said drawer for biasing said drawer out of said housing;

locking means disposed in said housing for engaging with said latch means when said drawer is manually pushed from an unlocked position into said housing to a locked position to thereby lock said drawer in said housing and for disengaging with said latch means when said locking means is in a manual mode and in an electrical mode, said locking means disengaging with said latch means in said manual mode in response to a manual push on said drawer which moves said drawer from said locked position to a position further into said housing, said locking means disengaging with said latch means in said electrical mode in response to an electrical signal received by said locking means and preventing disengagement with said latch means while in said electrical mode when said drawer is manually pushed from said locked position to a position further into said housing, said locking means including latch lever means for engaging said latch means to maintain said drawer in said locked position in said housing, latch lever release arm means for engaging said latch lever means to prevent said latch lever means from disengaging with said latch means, manual release arm means for disengaging said latch lever release arm means from said latch lever means only when said locking means is in said manual mode whereby said latch lever means disengages said latch means and said drawer moves to said unlocked position due to pressure exerted on said drawer by said spring means, and electrically actuated means connected to said latch lever release arm means for disengaging said latch lever release arm means from said latch lever means when said locking means is in said electrical mode to thereby allow said drawer to be unlocked due to pressure exerted on said drawer by said spring means; and control means connected to said locking means for selectively placing said locking means in either said manual mode or said electrical mode, said control means further supplying said electrical signal to said electrically actuated means to unlock said drawer when said locking means is in said electrical mode, said control means including connecting means connected to said manual release arm means for preventing said manual release arm means from disengaging said latch lever release arm means from said latch lever means due to pushing said drawer from said locked position to a position further into said housing when said locking means is in said electrical mode and said control means including switch means for supplying said electrical signal to said electrically actuated means to thereby disengage said latch lever release arm means from said latch lever means to unlock said drawer when said locking means is in said electrical mode.

17. The electro-manual drawer latch of claim 16, wherein said electrically actuated means comprises a solenoid having a piston slidable therein, said piston being connected to said latch lever release arm means and movable from a first position at which said latch lever release arm means engages said latch lever means to a second position at which said latch lever release arm means disengages said latch lever means to thereby allow said drawer to be unlocked due to pressure exerted thereon by said spring means when said piston is in said second position.

18. The electro-manual drawer latch of claim 16, wherein said control means includes a key lock extending through said housing, said key lock including a rotatable lock cam disposed in said housing, said switch means connected between said electrically actuated means and a power source, said switch means being engagable with said rotatable lock cam to maintain said locking means in said electrical mode when said key lock is in an electrical mode position, said control means including a rotatable switch lever which is rotated to a first position by said lock cam when said key lock is rotated to said electrical mode position, said switch means including an electrical signal sending means and a limit switch connected between said power source and said electrically actuated means, said limit switch engagable with said switch lever when said switch lever is in said first position, said limit switch allowing current to pass therethrough when said switch lever is in said first position due to rotation of said key lock to said electrical mode position.

19. The electro-manual drawer latch of claim 18, wherein said connecting means comprises a wire connected between said switch lever and said manual release arm means.

20. The electro-manual drawer latch of claim 18, wherein said connecting means comprises a pivotable plate means for engaging said manual release arm means and a wire connected between said switch lever and said pivotable plate means whereby said pivotable plate means is pivoted into engagement with said manual release arm means to prevent said manual release arm means from disengaging said latch lever release means from said latch lever means when said key lock is in said electrical mode position.

* * * * *